United States Patent [19]

Zijsling

[11] Patent Number: 4,624,330

[45] Date of Patent: Nov. 25, 1986

[54] ROTARY DRILL BIT WITH STRAINER ELEMENT

[75] Inventor: Djurre H. Zijsling, Rijswijk, Netherlands

[73] Assignee: Shell Oil Company, Houston, Tex.

[21] Appl. No.: 758,912

[22] Filed: Jul. 25, 1985

[30] Foreign Application Priority Data

Aug. 6, 1984 [NL] Netherlands ..... 8402431

[51] Int. Cl.[4] ..... E21B 10/60

[52] U.S. Cl. ..... 175/393; 175/340; 166/235

[58] Field of Search ..... 175/393, 339, 340, 314; 166/227, 235

[56] References Cited

U.S. PATENT DOCUMENTS

| | | | |
|---|---|---|---|
| 3,145,783 | 8/1964 | Sibley | 175/314 |
| 4,336,850 | 6/1982 | Fielder | 175/393 |
| 4,341,273 | 7/1982 | Walker et al. | 175/393 |

*Primary Examiner*—James A. Leppink
*Assistant Examiner*—Terry Lee Melius

[57] ABSTRACT

A rotary drill bit comprising a tubular strainer element co-axially arranged within the body of the bit and being provided with narrow axial slots arranged to prevent solid debris from passing to the nozzles of the bit. The self-cleaning ability of the strainer element is enhanced by increasing the bore of the strainer element in the region below the slots.

8 Claims, 7 Drawing Figures

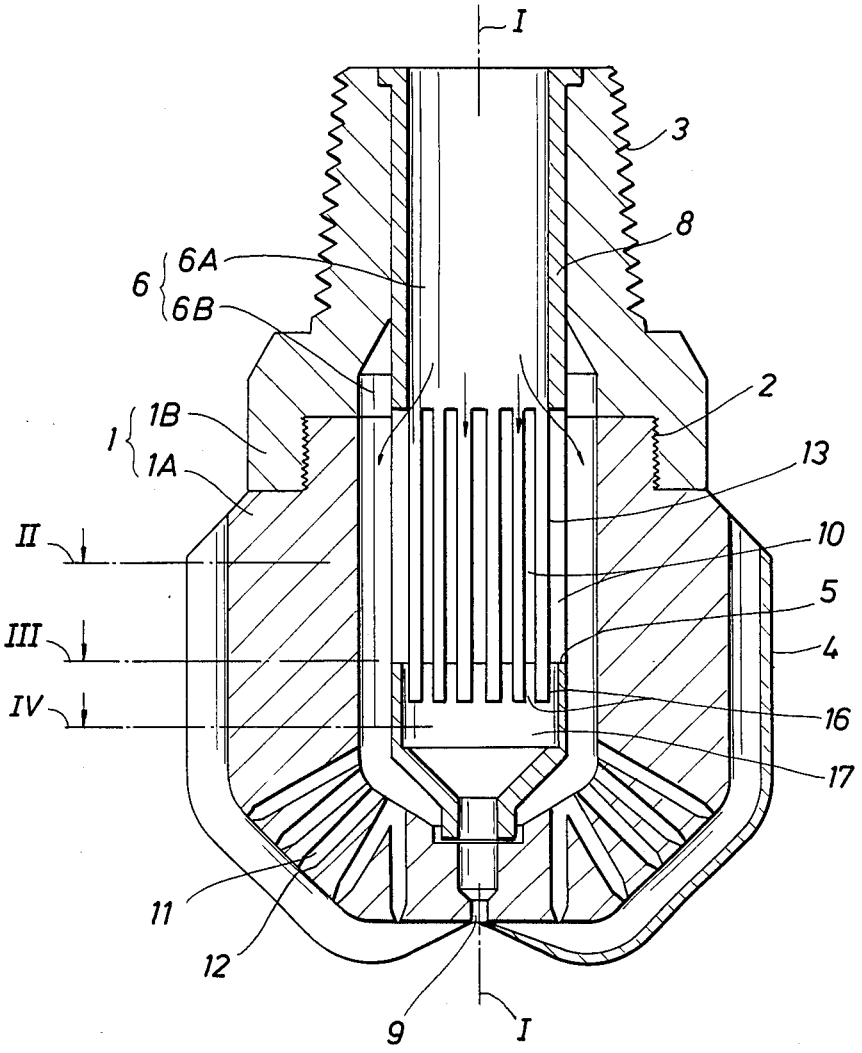
FIG. 1
FIG. 2
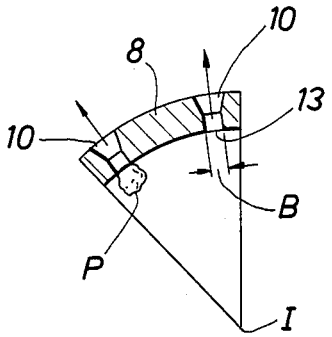
FIG. 3
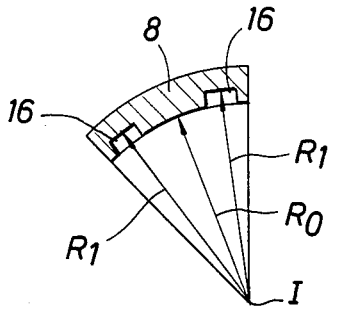
FIG. 4
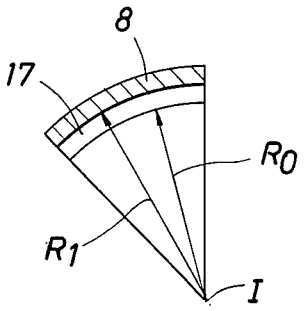

FIG. 5
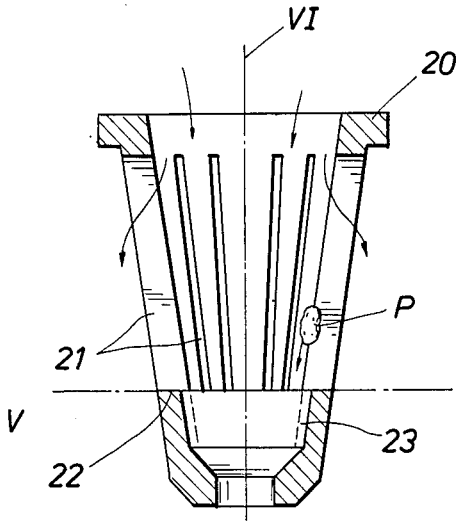
FIG. 6
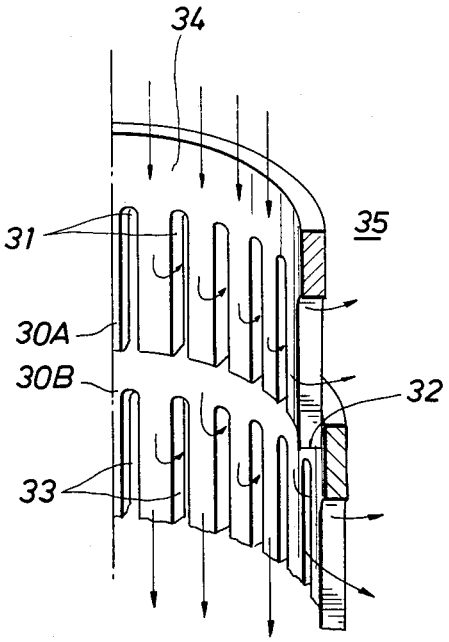
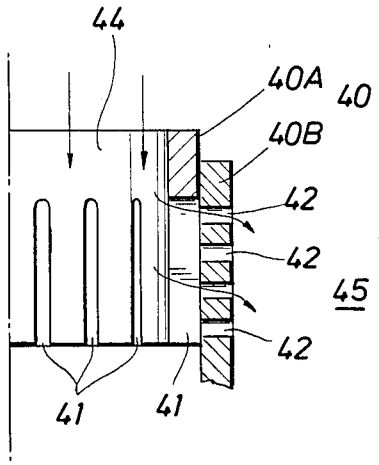
FIG. 7

ROTARY DRILL BIT WITH STRAINER ELEMENT

BACKGROUND OF THE INVENTION

The invention relates to a rotary drill bit for the drilling of wells in subterranean formations. The invention relates in particular to a rotary drill bit that is furnished with a tubular strainer element for the cleaning of drilling fluid flowing from a drill string connected to the bit to jet nozzles arranged in the bit. Such a bit is known from U.S. Pat. No. 4,341,273. In the bit known from that patent specification, the tubular strainer element is placed in such a manner that during drilling at least some of the drilling fluid flows out of the drill string in a substantially axial and downward direction through the space enclosed by the strainer element. In the wall of the strainer element, a number of fluid passages are arranged that lead into a space situated at the outside of the element, which space communicates with the jet nozzles. The fluid passages consist, at least at the fluid inlet side situated on the inside of the element, of substantially axially oriented slots.

In the known bit, the width of the axial slots is selected so that any solid particles present in the drilling fluid of such size that they could block the jet nozzles cannot pass through the slots and are entrained in the drilling fluid flowing in an axial and downward direction through the space enclosed by the strainer element to a central drilling fluid discharge port arranged in the bit, which port may consist of a central nozzle of a diameter selected large enough for the solid particles that cannot pass through the slots to be discharged from the space enclosed by the strainer element via the central nozzle. In the known bit, the purpose of the axial orientation of the slots is that the thereby intercepted solid particles are not sucked up against the inner wall of the strainer element by the radial flow through the slots but are flushed away from it by the axially and downwards directed flow. The flushing away of the solid particles implies that the strainer has a self-cleaning action.

SUMMARY OF THE INVENTION

In the course of experiments with the known bit, it has been found that the self-cleaning action is inadequate if the drilling fluid is extremely contaminated and that blockage of the slots occurs. The present invention is intended to provide a bit in which no blockage of the axial slots in the strainer element occurs, even in the event of extreme contamination of the drilling fluid.

To this end, in the bit according to the present invention the inside of th wall of that part of the strainer element section immediately underneath each slot during drilling is made wider than the inside of the wall of the element at the lower end of the slot located above.

BRIEF DESCRIPTION OF THE DRAWING

The invention can be put into practice in various ways and will, by way of example, be detailed further hereinbelow, with reference to the attached drawings, showing some suitable embodiments, wherein:

FIG. 1 represents a longitudinal section of a bit according to the invention wherein the tubular strainer element consists of a single cylindrical tube, FIG. 2 represents in detail a cross-section of a segment of the strainer element shown in FIG. 1 along the plane II perpendicular to the central axis I, as seen in the direction of the arrow, FIG. 3 represents in detail a cross-section of a segment of the strainer element shown in FIG. 1 along the plane III perpendicular to the central axis I, as seen in the direction of the arrow, FIG. 4 represents in detail a cross-section of a segment of the strainer element shown in FIG. 1 along the plant IV perpendicular to the central axis I, as seen in the direction of the arrow, FIG. 5 represents a cross-section of an alternative embodiment of the tubular strainer element arranged in the bit according to the invention wherein the strainer element is of conical shape, FIG. 6 represents a perspective view of a fragement of a third embodiment of the tubular strainer element arranged in the bit according to the invention wherein said element consists of two co-axial tubes, and FIG. 7 represnts a cross-section of a fourth embodiment of the tubular strainer element arranged in the bit according to the invention wherein said element consists of two co-axial tubes fitted one around the other over a relatively great length.

DESCRIPTION OF A PREFERRED EMBODIMENT

The rotary drill bit 1 represented in FIGS. 1, 2 and 3 consists of a bit body 1A and a shaft 1B, which bit components are interconnected by a screw-thread connection 2. The bit shaft 1B is furnished with a tapering screw thread 3 for connecting the bit 1 to the lower end of drill string (not shown). The bit 1 is furnished with cutting elements arranged on the bit body 1A.

In the bit there is a central cavity 6 in which a tubular strainer element 8 is arranged which divides the cavity into a central space 6A enclosed by the element 8 and an annular space 6B situated around part of the element 8. During drilling, the top of the central space 6A communicates with the bore of the drill string (not shown), through which bore the drilling fluid is supplied.

The bottom of the central space 6A communicates with a central nozzle 9 through which drilling fluid is passed to the bottom of the borehole to cool the cutting elements 4 and to flush away the drilling debris cut away from the bottom of the borehole by the elements 4. The diameter of the central nozzle 9 is selected large enough for even the largest solid particles that may be present in the drilling fluid to escape through it.

In the wall of the tubular strainer element 8, arranged co-axially in relation to the axis of rotation I of the bit 1, a series of axial slots 10 are arranged to form fluid passages in the wall of the element 8, through which some of the drilling fluid flows from the central space 6A to the annular space 6B during drilling and thence via a number of holes 11 to the jet nozzles 12 arranged on the surface of the bit body. The internal diameter of said jet nozzles is small and is generally selected to between 2 and 9 mm in order to impart a high exit velocity to the drilling fluid emerging from the nozzles 12 so that the sprays of fluid have an eroding effect on the bottom of the drillhole.

The breadth B of the slots 10 (FIG. 2) is selected so that only those particles can pass through that can also pass through the outlets of the jet nozzles. This prevents blockage of the jet nozzles during drilling in the course of time and deterioration of drilling action of the bit.

In the course of experiments, it has been found that blockage of jet nozzles 12 with an internal outlet diameter of 7 mm can be prevented by making the breadth B (see FIG. 2) at the fluid inlet side 13 of each slot 10 a maximum of 2 mm, whereas if the jet nozzles 12 have an internal outlet diameter of 5 mm, a slot breadth B of maximum 1 mm is required to prevent blockage of said nozzles.

As is evident from FIG. 2, the slots become wider in the radial direction from the central axis I so that the smallest breadth B of each slot 10 lies at the fluid inlet side 13 thereof. This prevents solid particles P that cannot pass through the slots from becoming lodged between the sidewalls of the slot so that they cannot be flushed away by the axial flow through the central space 6A to central nozzle 9.

In order to prevent blockage of the slots 10 in the event of extreme contamination of the drilling fluid, in the bit according to the invention, the inside or bore of the part of element 8 situated immediately underneath each slot 10 during drilling is made wider than the bore or inside of the wall of the element 8 adjacent and/or by the lower end 5 of the slot 10 situated above. The purpose of this widening of the bore of the element 8 at this point is to prevent rims from being formed at the lower ends of the slots 10, which rims could constitute bases for the accumulation of solids which, if the drilling fluid is highly contaminated, could accumulate over the entire lengths of the slots.

In the embodiment shown in FIGS. 1–4 of the bit according to the invention, the strainer element 8 is cylindrical by the slots 10 and the inner wall of the element 8 is situated at a radius of $R_0$ (see FIGS. 3 and 4) in relation to the central axis I over the entire length of the slot. In the bit shown, the widening of the space or bore within the lower end of element 8 consists of a series of axial flutes 16, milled in the inside wall or surface of the element 8, and a circumferential flute 17. Each of the axial flutes 16 lies along the extension of a slot 10 and has a slightly larger breadth than the breadth B of the fluid inlet side 13 of th slot 10 situated above. The flutes 16 and 17 are milled into the wall of the strainer element 8 to such a depth that the bottom of each flute is located at a radius $R_1$ from the central axis I, with $R_1 > R_0$. In the configuration shown in FIGS. 1–4, a solid particle P (see FIG. 2) that cannot pass through a slot 10 and is partially drawn into the slot 10 by the radial flow through the slot 10 will be caused, by the main axial flow, within the bore of element 8 in the axial downward direction, to slide or roll past the fluid inlet side 13 of the slot 10 and, on arrival at the lower end 15 of the slot, will continue to slide or roll, without deviating from the axial direction of movement, into the axial flutes 16, ending up in the circumferential flute 17, whence the particle P is discharged by the axial flow through the central nozzle 9 out of the space 6A.

In the course of experiments, it has been found that if the flute depth is larger than half the smallest slot breadth B, i.e., if $R_1 - R_0 > \frac{1}{2}B$, the self-cleaning effect of th strainer element was not impaired even if the drilling fluid was extremely contaminated.

In another form of the present invention, the tubular strainer element shown in FIG. 5 consists of a conically shaped tube 20 and the axial slots 21 milled in the wall of the tube 20 all terminate at their lower ends 22 in a terminating plane V that is perpendicular to the axis of symmetry VI, which is oriented substantially vertically during drilling, of the tube 20. The tube 20 continues underneath the terminating plane V and, in that part of the inside of the tube 20 situated immediately underneath the terminating plane V, a circumferential flute 23 is milled in the wall of tube 20 from the inner surface thereof in a manner to form a localized widening in relation to the inner circumference of the tube 20 by the lower ends 22 of the slots 21. The circumferential flute 23 fulfills the same function as the combination of axial and circumferential flutes shown in FIGS. 1–4, i.e. solid particles P that cannot pass through the slots 21 are able to pass the lower ends 22 of the slots 21 in the downward direction without requiring any deflection of the direction of movement into a radial direction against the flow directed towards the outside through the slots 21.

In FIG. 6 a fragment is shown of the tubular strainer element 30 applicable in the bit in accordance with the invention and consisting of two co-axial cylindrical tubes 30A and 30B that are partly fitted one around the other.

In the top tube 30A, axial flutes 31 are milled that continue to the lower end of said tube 30A and form fluid passages from the space 34 enclosed by the element 30 to the annular space 35 surrounding the element. As the bottom tube 30B fitted around the lower end 32 of the top tube 30A has a larger internal diameter than the top tube 30A, a widening is thereby formed of the strainer element part situated immediately underneath the lower ends 32 of the slots 31.

Axial slots 33 are likewise milled in the bottom tube 30B, which slots likewise form fluid passages from the central space 34 to the annular space 35. If so desired, the slots 33 can continue to the lower end (not shown) of the tube 30B, with a subsequent tube (not shown) fitted around the lower end of tube 30B.

The strainer element 40 shown in FIG. 7 similarly consists of two co-axial tubes 40A and 40B. The top tube 40A is identical to the tube 30A shown in FIG. 6, but the bottom tube 40B is fitted around the top tube 40A to such a depth that it fully covers the slots 41 arranged in said tube 40A. In order to allow fluid to flow radially through the slots 41, a series of holes 42 are drilled in outer tube 40B opposite each slot 41, which holes, in conjunction with the slots, form the fluid passages through the wall of the strainer element 40 from the space 44 enclosed by the element 40 to the space 45 surrounding the element. The diameter of the holes 42 is selected larger than the breadth of the slots 41.

The advantage of the construction shown in FIG. 7 is that the wall of the strainer element 40 by the slots 41 possess greater rigidity so that, even in the event of a very high pressure drop across the slots 41, no forcing open of the slots 41 will occur. It is obvious that the reinforced wall penetration construction shown in FIG. 7 can also be achieved by milling a series of axial flutes along the inside of the wall of a single tube and by drilling from the outside a series of holes that coincide with the milled flutes to form, in conjunction with the flutes, wall penetrations identical to the configuration shown in FIG. 7.

The invention is not limited to the type of bit shown in FIG. 1 but can likewise be applied in any other type of rotary bit such as a roller bit or a fish-tail bit wherein the drilling fluid is passed through jet nozzles with relatively small fluid outlets.

If so desired, the drilling fluid flowing in axial and downward direction through the space enclosed by the strainer element to the central nozzle can also be filtered by means of the sieve plate arranged above the central nozzle as disclosed in U.S. Pat. No. 4,391,273.

I claim as my invention:

1. Rotary drill bit comprising a bit body having a chamber therein, jet fluid discharge nozzles operatively carried by said bit body and extending through the wall of said bit, at least one fluid and particle discharge nozzle of a size larger than the jet nozzles and extending from the bit, a tubular strainer element coaxially mounted in said chamber in spaced relationship to the wall of the bit for the cleaning of drilling fluid flowing from a drill string, said strainer element having a cylindrical chamber form therein and an annular chamber outside thereof, adapted to be connected to the bit, to said jet fluid discharge nozzles arranged in the bit, wherein during drilling at least some of the drilling fluid flows in a substantially axial and downward direction through the annular chamber space enclosed by said element in communication with said particle discharge nozzle, the wall of said strainer element being provided with a number of fluid passages arranged to lead from said cylindrical chamber into a portion of the annular chamber portion of said bit chamber communicating with the jet nozzles and situated at the outside of the strainer element and which consist, at least at the fluid inlet side situated on the inside of the element, of substantially axially extending slots extending a distance over the major length of said annular chamber, characterized in that the inside of the wall of the part of the strainer element situated immediately underneath each slot during drilling is of a greater diameter for a selected axial distance downwardly than the inside of the wall of the strainer element at the point adjacent the lower end of the slot located above.

2. Bit as claimed in claim 1, characterized in that the central axis of the tubular strainer element coincides with the axis of rotation of the bit and that the fluid passages consists of a series of axially extending slots of which the breadth increases in the radial direction from the central axis, which slots are formed through the wall of the strainer element and continue with the lower ends terminating at a selected terminating plane perpendicular to the central axis of the bit.

3. Bit as claimed in claim 2, characterized in that the strainer element comprises a single tube that continues downwardly below the terminating plane of the slots, and a circumferential flute formed in the inner wall of the tube of which the flute top borders on the aforesaid terminating plane.

4. Bit as claimed in claim 3, characterized in that strainer element continues downwardly below the terminating plane of the slots, and axial flutes formed as extensions of the slots in the inside of that part of the tube situated underneath the slots, the breadth of said flutes being at least equal to the smallest breadth of the slots.

5. Bit as claimed in claim 4, characterized in that the axial flutes in the downward direction continue to the circumferential flute milled in the inside of the tube.

6. Bit as claimed in claim 2, characterized in that the strainer element comprises a first tube that continues to the terminating plane of the slots and that the wall of the strainer element part situated underneath the terminating plane is formed by and includes a second tube fitted co-axially around at least the lower end of the first tube.

7. Bit as claimed in claim 6, characterized in that fluid passages are formed in the second tube, which openings consist of a series of axial slots.

8. Bit as claimed in claim 6, characterized in that fluid passages in the first tube consist of a number of slots through the tube wall, with the second tube being fitted around the first tube such that it covers the slots, and a series of holes being arranged in the wall of the second tube opposite the slots with a diameter of the holes being greater than the smallest breadth of the slots so that said slots and drilled holes form fluid passages through both tubes.

* * * * *